US006677901B1

(12) United States Patent
Nalbandian

(10) Patent No.: US 6,677,901 B1
(45) Date of Patent: Jan. 13, 2004

(54) PLANAR TUNABLE MICROSTRIP ANTENNA FOR HF AND VHF FREQUENCIES

(75) Inventor: Vahakn Nalbandian, Ocean, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 167 days.

(21) Appl. No.: 10/099,580

(22) Filed: Mar. 15, 2002

(51) Int. Cl.[7] ..... H01Q 1/38
(52) U.S. Cl. ..... 343/700 MS; 343/846
(58) Field of Search ..... 343/700 MS, 745, 343/829, 846; 333/24 C, 161; H02Q 1/38

(56) References Cited

U.S. PATENT DOCUMENTS

| | | | | | |
|---|---|---|---|---|---|
| 4,684,952 | A | * | 8/1987 | Munson et al. | 343/700 MS |
| 5,617,104 | A | * | 4/1997 | Das | 343/700 MS |
| 5,777,581 | A | * | 7/1998 | Lilly et al. | 343/700 MS |
| 5,870,057 | A | * | 2/1999 | Evans et al. | 343/700 MS |
| 6,292,143 | B1 | * | 9/2001 | Romanofsky | 343/700 MS |
| 6,567,048 | B2 | * | 5/2003 | McKinzie et al. | 343/700 MS |

* cited by examiner

*Primary Examiner*—Tho Phan

(74) *Attorney, Agent, or Firm*—Michael Zelenka; George B. Tereschuk

(57) ABSTRACT

An electrically small planar tunable microstrip antenna is provided by stacking a radiating element, microstrip dielectric substrate and a ground plane, and coupling the ground plane to a means for tuning. The electrically small, compact, planar tunable microstrip antenna operates at HF and VHF frequencies. The microstrip dielectric substrate is composed of a ferrite or ferrite-ferroelectric composite material having a relative dielectric constant similar to a relative magnetic permeability forming a permittivity to permeability ratio of between about 1:1 and about 1:3. The ground plane is coupled to a means for tuning. In the ferrite-ferroelectric embodiment, the present invention provides an antenna length that is substantially shortened to approximately 1% of the length of a monopole antenna or conventional microstrip antenna with tuning accomplished by a multi-turn coil mechanism. The electrically small planar tunable microstrip antenna provides tuning by varying the $\in_r$ of the dielectric substrate's ferroelectric material by applying an electric field and by changing the $\mu_r$ of ferrite material in the dielectric substrate by applying a magnetic field to the ferrite material. This invention also encompasses methods for providing substantial reduction in antenna size at the HF and VHF frequencies with electrically small planar tunable microstrip antennas comprising a dielectric substrate composed of ferrite and ferrite-ferroelectric composite materials.

87 Claims, 2 Drawing Sheets

PLANAR TUNABLE MICROSTRIP ANTENNA FOR HF AND VHF FREQUENCIES

GOVERNMENT INTEREST

The invention described herein may be manufactured, used, imported, sold, and licensed by or for the Government of The United States of America without the payment to me of any royalty thereon.

FIELD OF THE INVENTION

The present invention relates generally to the field of microstrip antennas, and more particularly to planar tunable microstrip antennas for the HF and VHF frequencies.

BACKGROUND OF THE INVENTION

Microstrip antennas with a lightweight, low profile, low cost and planar structure have been replacing bulky antennas. The length of a rectangular microstrip antenna is about a half wavelength within the dielectric medium under the radiating patch, which is still relatively large at UHF and VHF frequencies, but these frequencies can impose size limitations resulting in bulky and cumbersome antenna structures. Due to the size limitation at UHF and VHF frequencies, previously available microstrip antennas were mainly limited to applications at higher frequencies. The disadvantage of size limitations in UHF and VHF has created a long-felt need to reduce antenna length. Up until now, it has not been possible to employ planar microstrip antennas without the disadvantages, limitations and shortcomings associated with antenna length and size. The present invention makes it possible to fulfill the need for an electrically small planar tunable microstrip antenna for the HF and VHF frequencies.

The long-awaited electrically small planar tunable microstrip antenna at for the HF and VHF frequencies offers a number of advantages over prior art antennas. Prior art rectangular microstrip antennas have a half wavelength length within the dielectric medium under the radiating patch, and this is extremely large at UHF and VHF frequencies. The electrically small planar microstrip antenna of the present invention provides the same high efficiency as conventional microstrip antennas, but it also offers a number of key advantages that permit significant decreases in antenna size, without suffering from the size limitations of prior art antenna structures. The present invention also fulfills the long-felt and unsatisfied need for an electrically small antenna for the lower frequencies.

The present invention fulfills the long-standing need for a significantly reduced antenna length and an electrically small antenna for the lower frequencies with a microstrip antenna structure fabricated with ferrite and ferrite-ferroelectric composite materials that permit both a considerably reduced antenna length and significantly high efficiency antenna performance. This invention's electrically small planar microstrip antenna also provides the additional advantage of being tunable. The present invention also advantageously provides an antenna with the same high efficiency as quarter wavelength monopole and conventional microstrip antennas, but with an antenna length shortened to about 1% of the length of a monopole antenna or conventional microstrip antenna, resulting in small microstrip antennas at low frequencies such as HF and VHF without suffering from the disadvantages, shortcomings and limitations of prior art microstrip antennas. To compensate for their very narrow bandwidth, these antennas can be easily tuned.

SUMMARY OF THE INVENTION

It is an object of this invention to provide an electrically small planar tunable microstrip antenna.

It is another object of this invention to provide an electrically small planar tunable microstrip antenna composed of ferrite materials that permits a substantial reduction in antenna size.

It is yet another object of this invention to provide an electrically small planar tunable microstrip antenna composed of ferrite materials that permits a substantial reduction in antenna size and operates efficiently at low HF and VHF frequencies.

It is still another object of this invention to provide an electrically small planar tunable microstrip antenna composed of ferrite-ferroelectric composite materials that permits a substantial reduction in antenna size and operates efficiently at low HF and VHF frequencies.

These and other objects are advantageously accomplished with the present invention providing an electrically small planar tunable microstrip antenna comprising stacking a radiating element, a ferrite microstrip dielectric substrate and a ground plane coupled to a means for tuning to provide an electrically small, compact, planar tunable microstrip antenna at HF and VHF frequencies. The present invention also provides an electrically small planar tunable microstrip antenna using ferrite-ferroelectric composite materials for the microstrip dielectric substrate. In the ferrite-ferroelectric embodiment, the present invention provides an antenna length that is substantially shortened to approximately 1% of the length of a monopole antenna or conventional microstrip antenna with tuning accomplished by a multi-turn coil mechanism. This invention also encompasses methods for providing substantial reduction in antenna size at the HF and VHF frequencies with electrically small planar tunable microstrip antennas comprising a dielectric substrate composed of ferrite and ferrite-ferroelectric composite-materials.

DETAILED DESCRIPTION OF THE DRAWINGS

The electrically small planar tunable microstrip antenna of the present invention advantageously comprises a radiating element, a ferrite microstrip dielectric substrate, a ground plane and a tuning means in an innovative stacking arrangement that provides an electrically small, reduced length for a microstrip antenna in the HF and VHF frequencies. The microstrip dielectric substrate can be fabricated from either ferrite or ferrite-ferroelectric composite materials. The stacking arrangement along with the innovative composition of the microstrip dielectric substrate provides a relative dielectric constant with a substantially similar relative permeability value, which results in a significantly reduced antenna length that is substantially shorter than conventional prior art microstrip antennas for the HF and VHF frequencies, without suffering from any of the disadvantages, drawbacks and limitations associated with much longer prior art conventional antennas.

The size of any microstrip antenna is determined by the wavelength within the substrate. For example, the length of a rectangular microstrip antenna is about half of the wavelength within the dielectric medium under a radiating patch. In order to reduce the size of the radiating patch or radiating element, the dielectric constant must be increased substantially for a smaller effective wavelength in the medium. The antenna's efficiency usually decreases with a substrate having a high dielectric constant. This invention's electrically small planar tunable microstrip antenna advantageously combines a number of antenna components, including a microstrip dielectric substrate fabricated from either a ferrite or ferrite-ferroelectric composite material, in an innovative stacking arrangement that provides a significant reduction in antenna length for HF and VHF microstrip antennas.

Figure 1:
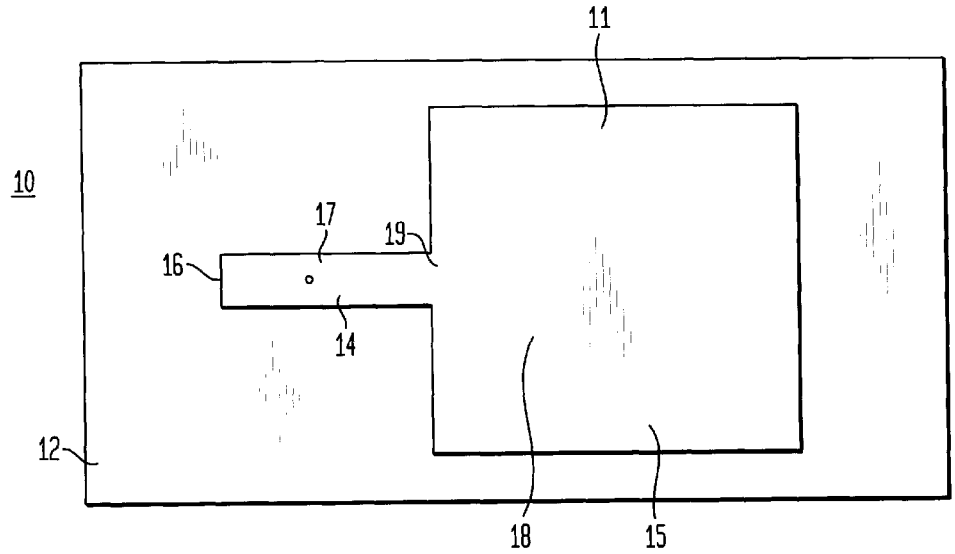
FIG. 1 is a top view of the radiating element stacked on the dielectric substrate in the ferrite embodiment of the present invention.

Referring now to the drawings, FIG. 1 is a top view of the electrically small planar tunable microstrip antenna 10 in the ferrite embodiment of the present invention with a radiating element 11 stacked on a microstrip dielectric substrate 12. The radiating element 11 further comprises a narrow portion 14 and a wide portion 15. The narrow portion 14 having a shorted end 16 shorted to an RF connector 17 projecting downward through the dielectric substrate 12. The wide portion 15 further comprises a central region 18 adjacent to the narrow portion 14. Wide portion 15 surrounds a segment of ground plane 13. For the sake of simplicity, a planar ground plane is depicted in the drawings; however, other shapes and geometrical configurations are also within the contemplation of the present invention.

Figure 2:
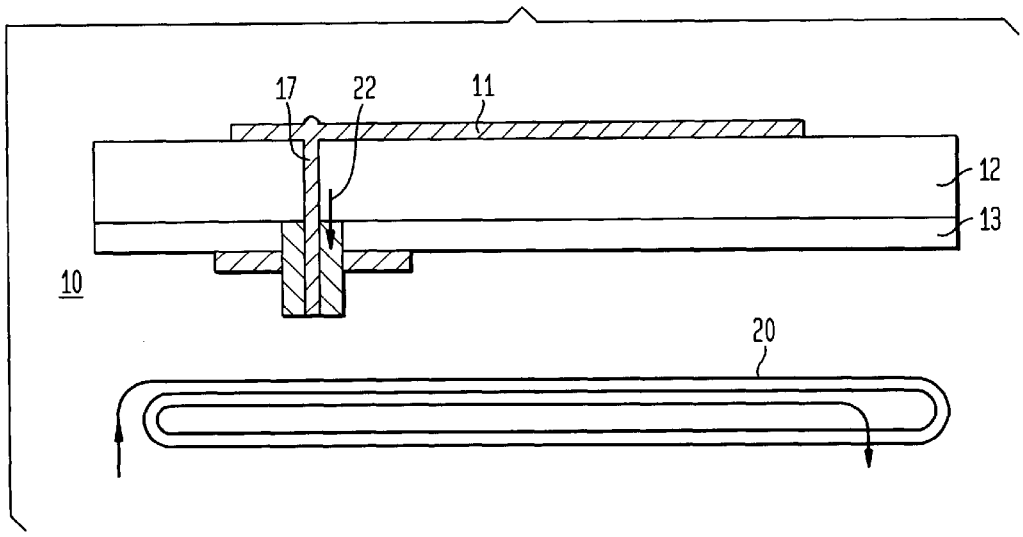
FIG. 2 is a cutaway side view of the stacked radiating element, dielectric substrate and ground plane of the present invention with a tuning means positioned under the radiating element and the dielectric substrate in the ferrite embodiment of the present invention.

FIG. 2 is a cutaway side view of the ferrite embodiment of the electrically small planar tunable microstrip antenna 10 of the present invention, using like numerals for like structures, with the microstrip dielectric substrate 12 being composed of a ferrite material and a tuning means 20 depicted underneath the ground plane 13. RF connector 17 projects through the dielectric substrate 12 and the ground plane 13. Arrow 22 represents RF current into the structure. When the dielectric substrate 12 is composed of a ferrite material, the tuning means 20 can be a tuning coil that generates a variable magnetic field that changes permeability, known as $\mu$. In this embodiment, suitable ferrite materials for dielectric substrate 12 include aluminum-doped garnet, a garnet material Gadolinium doped, a magnesium ferrite composition and a nickel ferrite composition with the appropriate combination of permittivity and permeability. When the microstrip dielectric substrate is composed of a ferrite-ferroelectric composite material, such as barium strontium titanate, the DC bias mechanism depicted in FIGS. 3 and 4 serves as the tuning means. Radiating element 11 may be made from any conductive metal, and in the preferred embodiment it is composed of copper. Ground plane 13 may also be made from conductive materials such as copper and aluminum.

Referring back to FIG. 1, in all embodiments, the radiating element 11 stacked on the dielectric substrate 12 provides a junction 19 in the central region 18 opposing the shorted end 16 of the radiating element 11, which is shorted to the ground plane 13. This arrangement shortens the length of the impedance transition and provides significantly reduced effective impedance, which is satisfied by the narrow portion 14 of the radiating element 11. The simplest example of significantly reduced effective impedance is a microstrip antenna with two rectangular patches of different widths that are connected to each other, where the end of the narrower patch is shorted, as is the case in FIG. 1. The effective impedance to be satisfied by the narrower strip at the junction is greatly reduced by the junction. While this technique can decrease the size of planar antennas by a factor of 10 to make them useful at upper VHF and UHF frequencies, this technique is inadequate to answer the long-standing need for a shortened antenna capable of reaching the power HF range (3 MHz). Some of the long-felt needs for shorter antenna lengths have been fulfilled by the antennas provided in "Compact Cylindrical Microstrip Antenna," U.S. Patent Office Serial No. 09/430,258, wherein this inventor was a co-inventor, which is hereby incorporated by reference, but those antennas were still very large at the lower frequencies. To provide an electrically small antenna capable of reaching the power HF range (3 MHz) in accordance with this invention, it is necessary to shrink the antenna by another factor of 30 to 100 to make the antenna compact and usable for moving platforms. The present invention focuses the antenna length reduction effort on the composition of dielectric substrate 12 to reduce the wavelength within the microstrip media without making the antenna inefficient.

Figure 3:
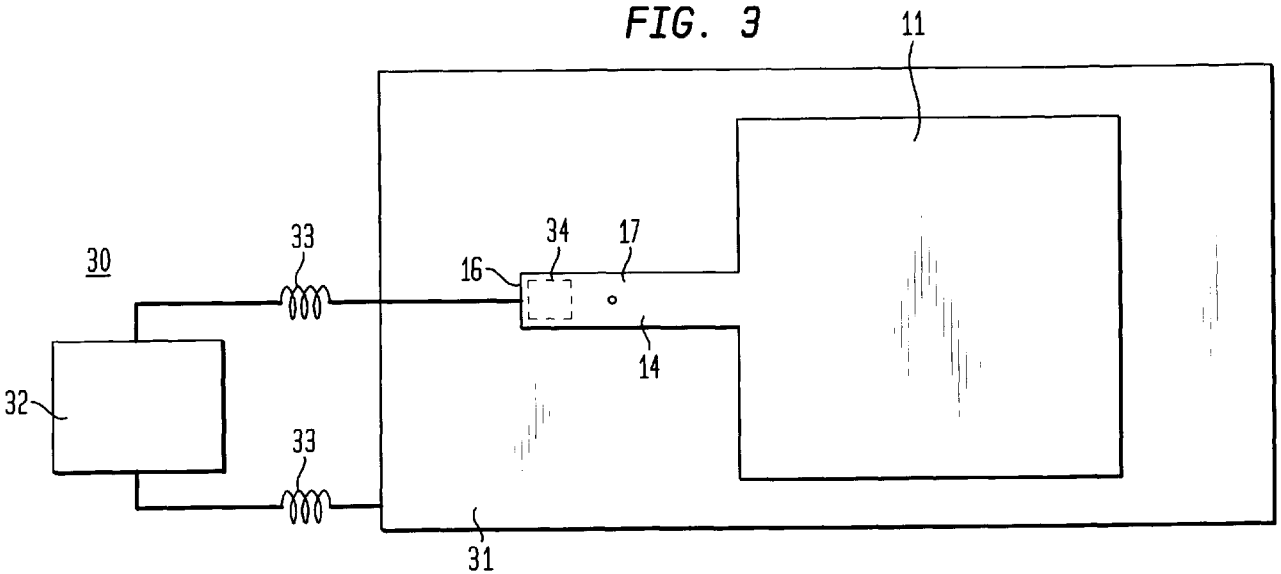
FIG. 3 a top view of the radiating element stacked on the dielectric substrate in the ferroelectric composite embodiment of the present invention.

Referring now to FIG. 3, which is a top view of the ferrite-ferroelectric composite embodiment of the electrically small planar tunable microstrip antenna 30 of the present invention, with like numerals for like structural elements, a microstrip antenna 30 is depicted with a different tuning mechanism that advantageously provides frequency tuning employing a high electric field that changes permittivity, known as $\in$, instead of the ferrite coil tuning means depicted in FIG. 2 where the magnetic field changes permeability $\mu$. Radiating element 11 is stacked on a ferrite-ferroelectric composite dielectric substrate 31. RF connector 17 projects through the dielectric substrate 31. The DC bias tuning means further comprises a DC power supply 32 connected to a pair of RF blocking inductors 33, and the radiating element 11 coupled to a chip capacitor 34 further depicted in FIG. 4 as being located within the dielectric substrate 13 and near the RF connector 17. In operation, the chip capacitor 34 provides DC isolation to the radiating element 11 from the planar ground plane 13. At high frequencies, this arrangement will look like a short.

Figure 4:
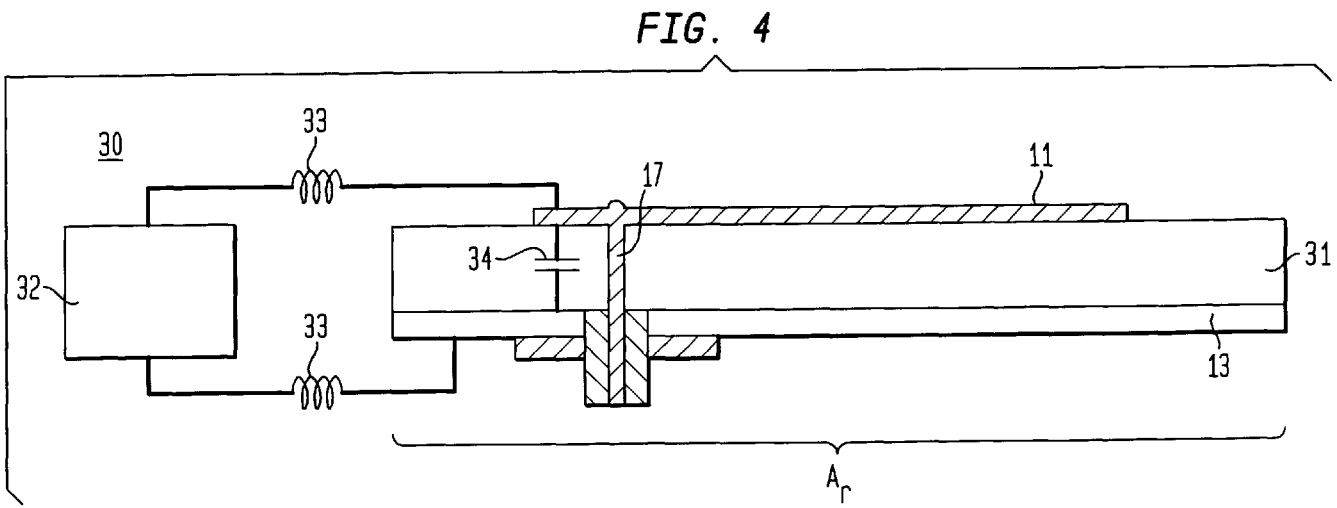
FIG. 4 is a cutaway side view of stacked radiating element, dielectric substrate and ground plane of the present invention with a DC bias as the tuning means in the ferroelectric embodiment of the present invention.

FIG. 4 is a cutaway side view of the ferrite-ferroelectric dielectric substrate 31 sandwiched between the radiating element 11 and ground plane 13, which depicts RF connector 17 projecting downward into dielectric substrate 31. This drawing also shows the reduced antenna length, $A_r$, as well as the DC bias as the tuning means.

The dielectric substrate 31 may be composed of any suitable ferrite-ferroelectric composite material, such as barium strontium titanate, provided it exhibits the necessary relative dielectric constant, $\in_r$, similar to a relative magnetic permeability, $\mu_r$, where $\in_r>1.0$ and $\mu_r>1.0$, to form a permittivity to permeability ratio of between about 1:1 and about 1:3, with a permittivity to permeability ratio close to 1:1 being preferable in accordance with this invention. In operation, this ferrite-ferroelectric composite embodiment of the electrically small planar tunable microstrip antenna 30 provides the same reduced wavelength as the preferred embodiment, along with additional features inherent in tuning the device without the variable magnetic field generated in the FIGS. 1 and 2 ferrite embodiment. The ferrite-ferroelectric composite dielectric substrate 31 is thicker than the ground plane 13, which, in turn, could either have a similar thickness or be thicker than radiating element 11. In all embodiments, the radiating element 11 is thinner than dielectric substrate 12 or 31, and dielectric substrate 12 or 31 is generally thicker than the ground plane 13, unless a large structure such as the fuselage of an airplane was used for the ground plane 13.

The present invention seeks to achieve a compact microstrip antenna in the power frequency range of HF and VHF by substantially reducing the antenna's size by decreasing the wavelength in the microstrip dielectric substrate media without making the antenna inefficient. This is accomplished by selecting ferrite or ferrite-ferroelectric composite materials for the dielectric substrate that exhibit a relative dielectric constant, $\in_r$, similar to a relative magnetic permeability, $\mu_r$, where $\in_r>1.0$ and $\mu_r>1.0$, to form a permittivity to permeability ratio of between about 1:1 and about 1:3, with a permittivity to permeability ratio close to 1:1 being preferable and antenna performance degrading beyond about 1:3. A microstrip dielectric substrate composed of such materials provides a significantly reduced antenna wavelength and the electrically smaller and shorter compact planar tunable microstrip antenna of the present invention.

Permittivity can be expressed as a product of two terms, one accounting for the dielectric properties of the material, and another accounting for the dielectric properties of free space. The symbol $\in$ denotes permittivity of any substance and $\in_o$ is the permittivity of free space, or a vacuum. Electric permittivity of a material is also defined as $\in=\in_r\in_o$ where $\in_r$ is the relative dielectric constant. Similarly, magnetic permeability of a vacuum is expressed as $\mu_o$ and the permeability of a material is defined as $\mu=\mu_r\mu_o$ where $\mu_r$ is the relative permeability of the given material. This invention's ability to achieve a decreased wavelength can be explained by the index of refraction principle known in the optical arts and microwave frequencies. The index of refraction is given by the following formula $\sqrt{\in_r\mu_r}=n$, and the index of refraction in free space is given by the formula: $\in_r=\mu_r=1$. In most substances, except the magnetic materials such as ferrite compounds, $\mu_r=1$, but for water, glass and other dielectric materials $\in_r>1$.

For good antenna efficiency it is desirable for RF energy inside the antenna to see similar impedance outside the antenna, according to the following formula:

$$\eta = \sqrt{\frac{\varepsilon_0\varepsilon_r}{\mu_0\mu_r}}$$

impedance in the antenna equals impedance of free space. When a material exhibits both a high dielectric constant and low magnetic permeability such that $\mu_r=1$, the antenna tends to operate inefficiently due to the free space mismatch, i.e. free space impedance given according to the following formula:

$$\eta_0 = \sqrt{\frac{\varepsilon_0}{\mu_0}} = 377 \text{ ohms}$$

which is achieved when $\in_r\approx\mu_r$. Accordingly, good antenna efficiency is achieved whenever the dielectric constant is similar to the magnetic permeability, where $\in_r\approx\mu_r$. Thus, dielectric materials having a combined similar relative permittivity and permeability, where, for example, the refractive index factor:

$$\sqrt{\in_r\mu_r}\geq 18$$

will exhibit excellent wavelength reduction potential when incorporated into the microstrip dielectric substrate 12 of the present invention. In one experiment, a ferrite microstrip dielectric substrate with a dielectric constant $\in_r\approx 25$ and a magnetic permeability $\mu_r$ of 25–75 provided antenna reduction of about 96%. It was also found that a multi-turn tuning coil behind a thin copper ground plane allowed the operator to tune the antenna frequency.

In one case a 3 MHz antenna was made in accordance with the present invention. In another case, a prototype antenna only 10 cm long was achieved. Thus, in accordance with the present invention when ferrite and ferrite-ferroelectric composite materials have $\in_r>1.0$ and $\mu_r>1.0$, with similar values and a permittivity to permeability ratio close to 1:1, or as much as 1:2 or even about 1:3, such materials used as the microstrip dielectric substrate 12 are tunable in accordance with the present invention. The reason that such materials employed as a dielectric substrate provide the combination of high antenna efficiency and tunability is that the substrate's impedance nearly approximates free space and offers only the slightest electrical resistance to current traveling through the antenna's dielectric substrate. Many commercially available ferrite and ferrite-ferroelectric composite materials meet these requirements. Examples of such commercially available ferrite materials include: Trans-Tech garnet material aluminum doped composition No. G-1009, where $\in_r=13.8$, $\mu_r=11$ and 11 is the initial relative permeability without any applied magnetic field; Trans-Tech garnet material Gadolinium doped composition No. G-1005, where $\in_r=15.4$ and the initial $\mu_r=26.0$; Trans-Tech magnesium ferrite composition No. TT1-390, where $\in_r=12.7$ and the initial $\mu_r=50.0$; Trans-Tech nickel ferrite composition No. TT2-113, where $\in_r=9.0$ and the initial $\mu_r=23.0$. One example of a commercially available ferrite-ferroelectric composite material is a Paratek Microwave barium strontium titanate ferrite-ferroelectric composite with a fixed $\mu_r$ that is tunable by varying the applied electric field on the material. Other commercially available ferrite and ferrite-ferroelectric composite materials also meet these requirements.

Numerous variations of the electrically small planar tunable microstrip antenna are possible and considered within the contemplation of the present invention. In addition to the ferrite and ferrite-ferroelectric composite materials described above, the radiating element may be fabricated from any conductive metal, with copper being the preferred alternative. Other tuning means besides the tuning coil and the DC bias could also be advantageously employed with the present invention. Similarly, if the ground plane is sufficiently thin it could also be formed into a hollow cylinder and then the antenna would provide a donut-shaped radiation pattern.

The present invention also encompasses a method for shortening a planar tunable microstrip antenna with a given length, $A_l$, comprising the steps of inserting a microstrip dielectric substrate between a radiating element and a conductive ground plane, forming the microstrip dielectric substrate from a material having a relative dielectric constant, $\in_r$, similar to a relative magnetic permeability, $\mu_r$, where $\in_r>1.0$ and $\mu_r>1.0$, forming a permittivity to permeability ratio of between about 1:1 and about 1:3, selecting the material from the group of materials consisting of ferrite compounds and ferrite-ferroelectric composite compounds, coupling a means for tuning, forming the radiating element with a narrow portion having a shorted end shorted to the ground plane, forming the radiating element with a wide portion having a central region near the narrow portion and a junction point opposing the shorted end, to provide a given impedance, providing an effective impedance value and a decreased wavelength in the dielectric substrate due to the permittivity to permeability ratio, causing a reduced effective impedance at the junction point and providing a reduced antenna length, $A_r$, due to the decreased wavelength, refractive index factor and reduced effective impedance that operates at HF and VHF frequencies. In accordance with the method of present invention, the material used in forming the dielectric substrate is selected from the ferrite compounds and ferrite-ferroelectric composite compounds described more fully above in connection with the device embodiments of this invention, such as the garnet material aluminum doped compound, garnet material Gadolinium doped compound, magnesium ferrite compound, nickel ferrite compound and barium strontium titanate. The other variations in the device embodiments can also apply to this invention's method.

It is to be understood that such other features and modifications to the foregoing detailed description are within the contemplation of the invention, which is not limited by this description. As will be further appreciated by those skilled in the art, any number of configurations, as well any number of combinations of circuits, differing materials and dimensions can achieve the results described herein. Accordingly, the present invention should not be limited by the foregoing description, but only by the appended claims.

What we claim is:

1. An electrically small, compact planar tunable microstrip antenna, comprising:

a microstrip dielectric substrate sandwiched between a radiating element and a conductive ground plane;

said microstrip dielectric substrate, being composed of a material having a relative dielectric constant, $\in_r$, similar to a relative magnetic permeability, $\mu_r$, where said $\in_r>1.0$ and said $\mu_r>1.0$, forming a permittivity to permeability ratio of between about 1:1 and about 1:3, said material being selected from group of materials consisting of ferrite compounds and ferrite-ferroelectric composite compounds;

a means for tuning;

said antenna having a given length, $A_l$;

said radiating element having a narrow portion and a wide portion;

said narrow portion having a shorted end shorted to said ground plane, and said wide portion, having a central region near said narrow portion and a junction point opposing said shorted end, provides a given impedance;

said dielectric substrate having an effective impedance value and a decreased wavelength due to said permittivity to permeability ratio;

said narrow portion causing a reduced effective impedance at said junction point; and said decreased wavelength, a refractive index factor and said reduced impedance permitting a reduced antenna length, $A_r$, that operates at HF and VHF frequencies.

2. The electrically small, compact planar tunable microstrip antenna, recited in claim 1, further comprising said permittivity to permeability ratio being about 1:1.

3. The electrically small, compact planar tunable microstrip antenna, as recited in claim 2, further comprising said material being a ferrite compound.

4. The electrically small, compact planar tunable microstrip antenna, as recited in claim 3, further comprising said ferrite compound being selected from the group of ferrite compounds consisting of the garnet material aluminum doped compound, garnet material Gadolinium doped compound, magnesium ferrite compound and nickel ferrite compound.

5. The electrically small, compact planar tunable microstrip antenna, as recited in claim 4, further comprising said tuning means being a tuning coil.

6. The electrically small, compact planar tunable microstrip antenna, as recited in claim 5, further comprising said garnet material aluminum doped compound where said $\in_r=13.8$, said $\mu_r=11$ and 11 is an initial relative permeability without any applied magnetic field.

7. The electrically small, compact planar tunable microstrip antenna, as recited in claim 5, further comprising said garnet material Gadolinium doped compound where said $\in_r=15.4$ and an initial $\mu_r=26.0$.

8. The electrically small, compact planar tunable microstrip antenna, as recited in claim 5, further comprising said magnesium ferrite compound where said $\in_r=12.7$ and an initial $\mu_r=50.0$.

9. The electrically small, compact planar tunable microstrip antenna, as recited in claim 5, further comprising said nickel ferrite compound where said $\in_r=9.0$ and an initial $\mu_r=23.0$.

10. The electrically small, compact planar tunable microstrip antenna, as recited in claim 5, further comprising said reduced antenna length, $A_r$, being shorter than said given length, $A_l$.

11. The electrically small, compact planar tunable microstrip antenna, as recited in claim 10, further comprising said radiating element being composed of a first metal.

12. The electrically small, compact planar tunable microstrip antenna, as recited in claim 11, wherein said first metal is copper.

13. The electrically small, compact planar tunable microstrip antenna, as recited in claim 10, further comprising said ground plane being composed of a second metal.

14. The electrically small, compact planar tunable microstrip antenna, as recited in claim 13, further comprising said second metal being selected from the group consisting of aluminum and copper.

15. The electrically small, compact planar tunable microstrip antenna, as recited in claim 10, further comprising said tuning coil being located beneath said ground plane.

16. The electrically small, compact planar tunable microstrip antenna, recited in claim 15, further comprising said dielectric substrate is positioned on top of said ground plane.

17. The electrically small, compact planar tunable microstrip antenna, recited in claim 16, further comprising said dielectric substrate having a thickness greater than said radiating element.

18. The electrically small, compact planar tunable microstrip antenna, recited in claim 17, further comprising said ground plane being thinner than said dielectric substrate.

19. The electrically small, compact planar tunable microstrip antenna, as recited in claim 18, further comprising said dielectric substrate having a refractive index factor of $\sqrt{\in_r\mu_r}>18$.

20. The electrically small, compact planar tunable microstrip antenna, as recited in claim 19, further comprising said antenna operating at about 3 MHz.

21. The electrically small, compact planar tunable microstrip antenna, as recited in claim 20, further comprising said reduced antenna length, $A_r$, is 10 cm.

22. The electrically small, compact planar tunable microstrip antenna, as recited in claim 21 further comprising said dielectric substrate being cylindrical.

23. The electrically small, compact planar tunable microstrip antenna, as recited in claim 2, further comprising said material being a ferrite-ferroelectric composite compound.

24. The electrically small, compact planar tunable microstrip antenna, recited in claim 23, wherein said tuning means is a DC bias.

25. The electrically small, compact planar tunable microstrip antenna, as recited in claim 24, further comprising said ferrite-ferroelectric composite compound being barium strontium titanate.

26. The electrically small, compact planar tunable microstrip antenna, as recited in claim 25, further comprising said barium strontium titanate compound having a fixed $\mu_r$ being tunable by varying an applied electric field on said dielectric substrate.

27. The electrically small, compact planar tunable microstrip antenna, recited in claim 26, further comprising said tuning means being a DC bias voltage on said barium strontium titanate compound changing its electric permittivity and thus changing its dielectric constant and frequency.

28. The electrically small, compact planar tunable microstrip antenna, as recited in claim 27, further comprising said dielectric substrate being cylindrical.

29. An electrically small, compact planar tunable microstrip antenna, comprising:

a microstrip dielectric substrate sandwiched between a radiating element and a conductive ground plane;

said microstrip dielectric substrate, being composed of a ferrite material having a relative dielectric constant, $\in_r$, similar to a relative magnetic permeability, $\mu_r$, where said $\in_r>1.0$ and said $\mu_r>1.0$, forming a permittivity to permeability ratio of between about 1:1 and about 1:3;

a means for tuning;

said antenna having a given length, $A_l$;

said radiating element having a narrow portion and a wide portion;

said narrow portion having a shorted end shorted to said ground plane, and said wide portion, having a central region near said narrow portion and a junction point opposing said shorted end, provides a given impedance;

said dielectric substrate having an effective impedance value and a decreased wavelength due to said permittivity to permeability ratio;

said narrow portion causing a reduced effective impedance at said junction point; and said decreased wavelength, a refractive index factor and said reduced effective impedance permitting a reduced antenna length, $A_r$, that operates at HF and VHF frequencies.

30. The electrically small, compact planar tunable microstrip antenna, recited in claim 29, further comprising said permittivity to permeability ratio being about 1:1.

31. The electrically small, compact planar tunable microstrip antenna, as recited in claim 30, further comprising said ferrite material being selected from the group of ferrite compounds consisting of garnet material aluminum doped compound, garnet material Gadolinium doped compound, magnesium ferrite compound and nickel ferrite compound.

32. The electrically small, compact planar tunable microstrip antenna, as recited in claim 31, further comprising said tuning means being a tuning coil.

33. The electrically small, compact planar tunable microstrip antenna, as recited in claim 32, further comprising said garnet material aluminum doped compound where said $\in_r=13.8$, said $\mu_r=11$ and 11 is an initial relative permeability without any applied magnetic field.

34. The electrically small, compact planar tunable microstrip antenna, as recited in claim 32, further comprising said garnet material Gadolinium doped compound where said $\in_r=15.4$ and an initial $\mu_r=26.0$.

35. The electrically small, compact planar tunable microstrip antenna, as recited in claim 32, further comprising said magnesium ferrite compound where said $\in_r=12.7$ and an initial $\mu_r=50.0$.

36. The electrically small, compact planar tunable microstrip antenna, as recited in claim 32, further comprising said nickel ferrite compound where said $\in_r=9.0$ and an initial $\mu_r=23.0$.

37. The electrically small, compact planar tunable microstrip antenna, as recited in claim 32, further comprising said reduced antenna length, $A_r$, being shorter than said given length, $A_l$.

38. The electrically small, compact planar tunable microstrip antenna, as recited in claim 32, further comprising said radiating element being composed of a first metal.

39. The electrically small, compact planar tunable microstrip antenna, as recited in claim 38, wherein said first metal is copper.

40. The electrically small, compact planar tunable microstrip antenna, as recited in claim 32, further comprising said ground plane being composed of a second metal.

41. The electrically small, compact planar tunable microstrip antenna, as recited in claim 40, further comprising said second metal being selected from the group consisting of aluminum and copper.

42. The electrically small, compact planar tunable microstrip antenna, as recited in claim 32, further comprising said tuning coil being located beneath said ground plane.

43. The electrically small, compact planar tunable microstrip antenna, recited in claim 42, further comprising said dielectric substrate is positioned on top of said ground plane.

44. The electrically small, compact planar tunable microstrip antenna, recited in claim 43, further comprising said dielectric substrate having a thickness greater than said radiating element.

45. The electrically small, compact planar tunable microstrip antenna, recited in claim 44, further comprising said ground plane being thinner than said dielectric substrate.

46. The electrically small, compact planar tunable microstrip antenna, as recited in claim 45, further comprising said dielectric substrate having a refractive index factor of $\sqrt{\in_r \mu_r} \geqq 18$.

47. The electrically small, compact planar tunable microstrip antenna, as recited in claim 46, further comprising said antenna reaching the lower frequency of the HF range.

48. The electrically small, compact planar tunable microstrip antenna, as recited in claim 47, further comprising said reduced antenna length, $A_r$, is 10 cm.

49. The electrically small, compact planar tunable microstrip antenna, as recited in claim 48, further comprising said dielectric substrate being cylindrical.

50. An electrically small, compact planar tunable microstrip antenna, comprising:

a microstrip dielectric substrate sandwiched between a radiating element and a conductive ground plane;

said microstrip dielectric substrate, being composed of a ferrite-ferroelectric composite material having a relative dielectric constant, $\in_r$, similar to a relative magnetic permeability, $\mu_r$, where said $\in_r>1.0$ and said $\mu_r>1.0$, forming a permittivity to permeability ratio of between about 1:1 and about 1:3;

a means for tuning is coupled to a DC power source;

said antenna having a given length, $A_l$;

said radiating element having a narrow portion and a wide portion;

said narrow portion having a shorted end shorted to said ground plane, and said wide portion, having a central region near said narrow portion and a junction point opposing said shorted end, provides a given impedance;

said dielectric substrate having a decreased wavelength due to said permittivity to permeability ratio;

said narrow portion causing a reduced effective impedance at said junction point; and said decreased wavelength, a refractive index factor and said reduced effective impedance permitting a reduced antenna length, $A_r$, that operates at HF and VHF frequencies.

51. The electrically small, compact planar tunable microstrip antenna, as recited in claim 50, further comprising said permittivity to permeability ratio being about 1:1.

52. The electrically small, compact planar tunable microstrip antenna, as recited in claim 51, further comprising said ferrite-ferroelectric composite material being barium strontium titanate.

53. The electrically small, compact planar tunable microstrip antenna, recited in claim 52, wherein said tuning means is a DC bias.

54. The electrically small, compact planar tunable microstrip antenna, as recited in claim 53, further comprising said reduced antenna length, $A_r$, is shorter than said given length, $A_l$.

55. The electrically small, compact planar tunable microstrip antenna, as recited in claim 54, further comprising said radiating element being composed of a first metal.

56. The electrically small, compact planar tunable microstrip antenna, as recited in claim 55, wherein said first metal is copper.

57. The electrically small, compact planar tunable microstrip antenna, as recited in claim 54, further comprising said ground plane being composed of a second metal.

58. The electrically small, compact planar tunable microstrip antenna, as recited in claim 57, further comprising said second metal being selected from the group of consisting of aluminum and copper.

59. The electrically small, compact planar tunable microstrip antenna, recited in claim 54, further comprising said dielectric substrate is positioned on top of said ground plane.

60. The electrically small, compact planar tunable microstrip antenna, as recited in claim 59, further comprising said dielectric substrate having a thickness greater than said radiating element.

61. The electrically small, compact planar tunable microstrip antenna, recited in claim 60, further comprising said ground plane being thinner than said dielectric substrate.

62. The electrically small, compact planar tunable microstrip antenna, recited in claim 61, further comprising said dielectric substrate having a refractive index factor of $\sqrt{\in_r \mu_r} \geqq 18$.

63. The electrically small, compact planar tunable microstrip antenna, recited in claim 62, further comprising:

said tuning means includes a chip capacitor;

said chip capacitor being coupled to said DC power source by a plurality of RF blocking inductors; and said chip capacitor being coupled to said radiating element.

64. The electrically small, compact planar tunable microstrip antenna, recited in claim 63, further comprising said chip capacitor being located in the vicinity of said RF inductors.

65. The electrically small, compact planar tunable microstrip antenna, as recited in claim 64, further comprising said barium strontium titanate compound having a fixed $\mu_r$ being tunable by varying an applied electric field on said microstrip dielectric substrate.

66. The electrically small, compact planar tunable microstrip antenna, as recited in claim 65, further comprising said antenna being an HF antenna operating in the 3 MHz range.

67. The electrically small, compact planar tunable microstrip antenna, as recited in claim 66, further comprising said reduced antenna length, $A_r$, is 10 cm.

68. The electrically small, compact planar tunable microstrip antenna, as recited in claim 67, further comprising said ground plane being cylindrical.

69. A method for shortening a planar tunable microstrip antenna with a given length, $A_l$, comprising the steps of:

inserting a microstrip dielectric substrate between a radiating element and a conductive ground plane;

forming said microstrip dielectric substrate from a material having a relative dielectric constant, $\in_r$, similar to a relative magnetic permeability, $\mu_r$, where said $\in_r > 1.0$ and said $\mu_r > 1.0$, forming a permittivity to permeability ratio of between about 1:1 and about 1:3, said material being selected from group of materials consisting of ferrite compounds and ferrite-ferroelectric composite compounds;

coupling a means for tuning;

forming said radiating element with a narrow portion having a shorted end shorted to said ground plane;

forming said radiating element with a wide portion, said wide portion, having a central region near said narrow portion and a junction point opposing said shorted end, provides a given impedance;

providing an effective impedance value and a decreased wavelength in said dielectric substrate due to said permittivity to permeability ratio;

causing a reduced effective impedance at said junction point; and providing a reduced antenna length, $A_r$, due to said decreased wavelength, a refractive index factor and said reduced impedance that operates at HF and VHF frequencies.

70. The method for shortening a planar tunable microstrip antenna, as recited in claim 69, further comprising the step of providing said permittivity to permeability ratio at about 1:1.

71. The method for shortening a planar tunable microstrip antenna, as recited in claim 70, further comprising the step of forming said material from a ferrite compound.

72. The method for shortening a planar tunable microstrip antenna, as recited in claim 71, further comprising the step of selecting said ferrite compound from the group of ferrite compounds consisting of:

a garnet material aluminum doped compound where said $\in_r = 13.8$, said $\mu_r = 11$ and 11 is an initial relative permeability without any applied magnetic field;

a garnet material Gadolinium doped compound where said $\in_r = 15.4$ and an initial $\mu_r = 26.0$;

a magnesium ferrite compound where said $\in_r = 12.7$ and an initial $\mu_r = 50.0$; and a nickel ferrite compound where said $\in_r = 9.0$ and an initial $\mu_r = 23.0$.

73. The method for shortening a planar tunable microstrip antenna, as recited in claim 72, further comprising the step of forming said tuning means from a tuning coil.

74. The method for shortening a planar tunable microstrip antenna, as recited in claim 73, further comprising the step of forming said radiating element from a first metal.

75. The method for shortening a planar tunable microstrip antenna, as recited in claim 74, further comprising the step of forming said radiating element from copper.

76. The method for shortening a planar tunable microstrip antenna, as recited in claim 73, further comprising the step of forming said ground plane from a second metal.

77. The method for shortening a planar tunable microstrip antenna, as recited in claim 76, further comprising the step of selecting said second metal from the group consisting of aluminum and copper.

78. The method for shortening a planar tunable microstrip antenna as recited in claim 73, further comprising the step of providing said dielectric substrate with a refractive index factor of $\sqrt{\in_r \mu_r} \geqq 18$.

79. The method for shortening a planar tunable microstrip antenna, as recited in claim 78, further comprising the step of forming an antenna operating at the 3 MHz range.

80. The method for shortening a planar tunable microstrip antenna, as recited in claim 79, further comprising the step of permitting said reduced antenna length, $A_r$, to be 10 cm.

81. The method for shortening a planar tunable microstrip antenna, as recited in claim 80, further comprising the step of forming said dielectric substrate into a cylindrical shape.

82. The method for shortening a planar tunable microstrip antenna, as recited in claim 70, further comprising the step of forming said material from a ferrite-ferroelectric composite compound.

83. The method for shortening a planar tunable microstrip antenna, as recited in claim 82, further comprising the step of forming said tuning means from a DC bias.

84. The method for shortening a planar tunable microstrip antenna, as recited in claim 83, further comprising the step of forming said ferrite-ferroelectric composite compound from barium strontium titanate.

85. The method for shortening a planar tunable microstrip antenna, as recited in claim 84, further comprising the step of providing said barium strontium titanate compound with a fixed $\mu_r$ being tunable by varying an applied electric field on said dielectric substrate.

86. The method for shortening a planar tunable microstrip antenna, as recited in claim 85, further comprising the step of applying a DC bias voltage on said barium strontium titanate compound to change its electric permittivity and thus change its dielectric constant and frequency.

87. The method for shortening a planar tunable microstrip antenna, as recited in claim 86, further comprising the step of forming said dielectric substrate into a cylindrical shape.

* * * * *